US006449429B1

(12) United States Patent
Kim

(10) Patent No.: US 6,449,429 B1
(45) Date of Patent: Sep. 10, 2002

(54) INDIRECTLY HEATING TYPE OF ELECTRIC BOILER APPARATUS

(76) Inventor: Kiho Kim, 981, DaJuk-Li, Sanwe-Myon, Milyang (KR)

( * ) Notice: Subject to any disclaimer, the term of this patent is extended or adjusted under 35 U.S.C. 154(b) by 0 days.

(21) Appl. No.: 09/863,850

(22) Filed: May 23, 2001

(30) Foreign Application Priority Data

Nov. 2, 2000 (KR) ..... 64934

(51) Int. Cl.[7] ..... F24H 1/10
(52) U.S. Cl. ..... 392/493; 392/502; 122/13.07
(58) Field of Search ..... 392/465, 466, 392/471, 480, 485, 487, 489, 491, 493, 502, 498; 122/13.07, 19.1, 19.2

(56) References Cited

U.S. PATENT DOCUMENTS 2,592,340 A * 4/1952 Ronceray ..... 164/212

* cited by examiner

*Primary Examiner*—Mark Paschall
*Assistant Examiner*—Thor Campbell
(74) *Attorney, Agent, or Firm*—Notaro & Michalos P.C.

(57) ABSTRACT

Disclosed is an indirectly heating type of an electric boiler capable of operating at a high efficiency using less energy. The boiler comprises a rubber casing including a port for receiving a cool water, a port for exhausting a hot water, the ports being provided opposite to each other, and a port for receiving a supplement water, a hole formed on both sides thereof, a heat accumulator accommodated into the rubber casing, secured to the rubber casing by fixing protrusions formed on both sides, and including recessed portions formed between a left and right step and having a height higher than that of the steps; a temperature control unit, secured to a left side of the heat accumulator, for controlling a surface temperature of the heat accumulator; a temperature adjusting unit, secured to a right side of the heat accumulator, for controlling a temperature of the hot water; heating means inserted into a hole of the heat accumulator and being heated by a power; a hot water heating unit consisting of a supplement tank; a circulating pump consisting of a shading motor; and a hot water pipe.

8 Claims, 8 Drawing Sheets

INDIRECTLY HEATING TYPE OF ELECTRIC BOILER APPARATUS

FIELD OF THE INVENTION

The present invention relates generally to a heating apparatus, and more particularly to an indirectly heating type of an electric boiler capable of operating at a high efficiency using less energy.

DESCRIPTION OF THE RELATED ART

In a conventional boiler, a heating medium or water is directly heated by a heating unit, and the heated water or a high temperature heating medium is fed to a hot water pipe by means of a circulating pump. Such a type of the boiler has some disadvantages as followings.

The boiler adopts an electric heater or burner in order to heat the fluid medium. The fluid medium is directly heated by the heat generated from the electric heater or burner, so that the efficiency of the boiler is not high relative to the input quantity of energy.

More specifically, the fluid medium or water is in contact with the electric heater, and so the fluid medium boils on a surface of the electric heater. When the fluid medium is boiling, bubbles are generated, such that the bubbles prevents the heat transfer of the electric heater from being transferred to the fluid medium. Accordingly, although the boiler uses a lot of energy, it operates at lower efficiency. Also, in case of the burner, since the water or fluid medium in a heating tube heated by a burner boils, the above problem is happened.

Therefore, it is necessary for the conventional boiler to exhaust periodically the bubbles produced in the hot water heating unit and the hot water pipe. In addition, when the water or fluid medium flows in the hot water heating unit and the hot water pipe, a noise or vibration is happened. If the bubble is not exhausted periodically, the efficiency of the boiler is decreased rapidly, thereby causing the trouble of boiler.

In addition, because the hot water or heated fluid medium is rapidly cooled simultaneous with the shut-off of the power, a lot of energy has to be used to heat the fluid medium again.

As described above, because the conventional boiler heating directly the fluid medium produces the bubbles due to the boiling effect of the fluid medium, if a diameter or volume of the heating tube is small, the heat of the heating member is not transferred to the fluid medium. At that time, the fluid medium may be changed into the bubbles. Accordingly, there is a limit in that the hot water heating unit and the circulating pump are minatured.

DISCLOSURE OF THE INVENTION

Therefore, in order to solve the problems involved in the prior art, it is an object of the present invention to provide an electric boiler apparatus capable of indirectly heating a fluid medium by means of a heating member.

It is another object of the present invention to provide an electric boiler apparatus capable of obtaining a high efficiency using less energy.

It is still another object of the present invention to provide an electric boiler apparatus capable of miniaturing a hot water heating unit and a circulating pump.

In order to achieve the above objects, according to one aspect of the present invention, there is provided an electric boiler apparatus capable of indirectly heating a fluid medium, the apparatus comprising: a rubber casing including a port for receiving a cool water, a port for exhausting a hot water, the ports being provided opposite to each other, and a port for receiving a supplement water, a hole formed on both sides thereof; a heat accumulator accommodated into the rubber casing, secured to the rubber casing by fixing protrusions formed on both sides, and including recessed portions formed between a left and right step and having a height higher than that of the steps; a temperature control unit, secured to a left side of the heat accumulator, for controlling a surface temperature of the heat accumulator; a temperature adjusting unit, secured to a right side of the heat accumulator, for controlling a temperature of the hot water; heating means inserted into a hole of the heat accumulator and being heated by a power; a hot water heating unit consisting of a supplement tank; a circulating pump consisting of a shading motor; and a hot water pipe.

The heat accumulator is made of metal or nonferrous metal. Preferably, the heat accumulator is made of aluminum.

The heating means comprises a positive temperature coefficient or an electric heater.

The pump is secured by inserting T-shaped protrusion formed continuously on a circumference of a body into T-shaped grooves formed continuously on an inner periphery of the shading motor.

An outer surface of the pump is plated with an anodizing coating film. The pump is made of synthetic resin.

BRIEF DESCRIPTION OF THE DRAWINGS

The above object, other features and advantages of the present invention will become more apparent by describing the preferred embodiment thereof with reference to the accompanying drawings, in which.

BEST MODE FOR CARRYING OUT THE INVENTION

Now, a heating apparatus according to a preferred embodiment of the present invention will be described in detail with reference to accompanying drawings.

Figure 1:
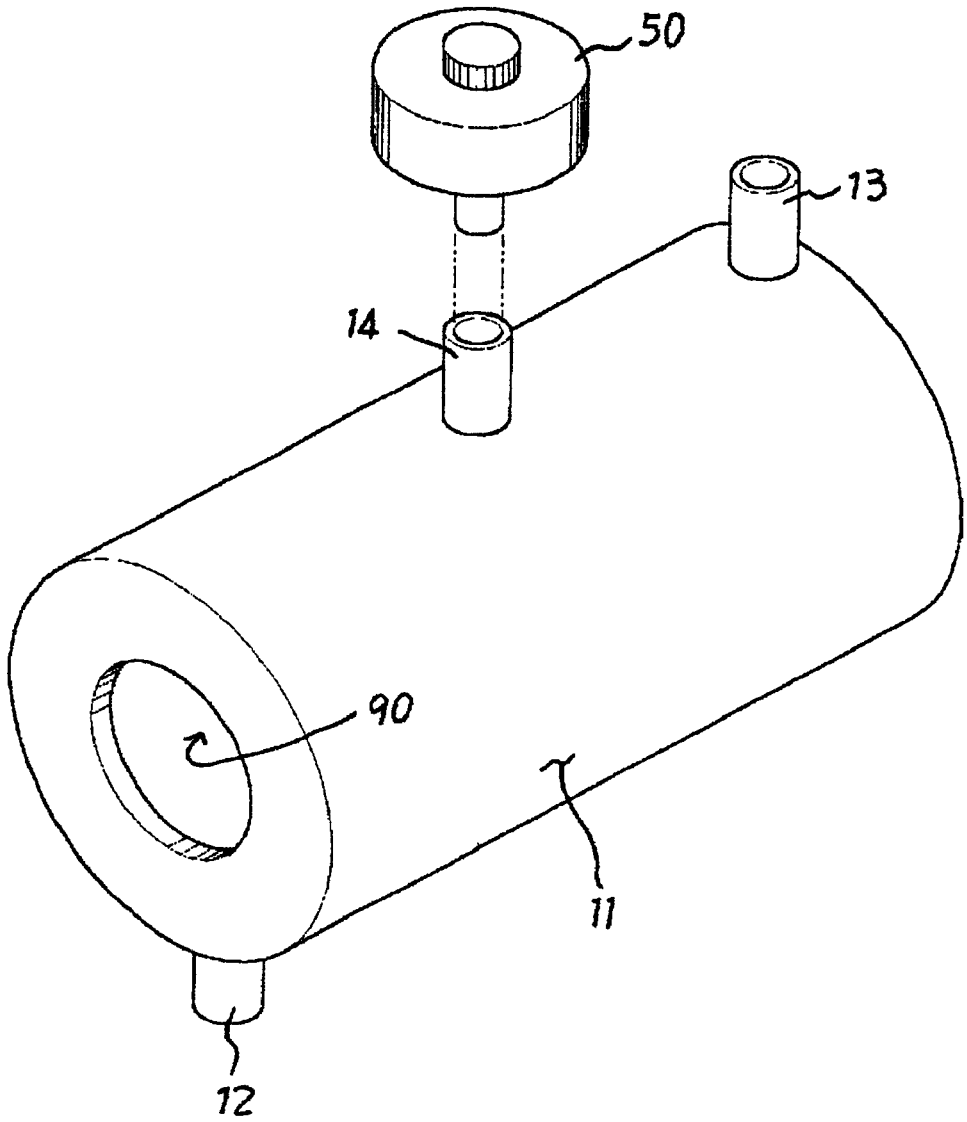
FIG. 1 is a perspective view illustrating a rubber casing according to a embodiment of the present invention.
Figure 2:
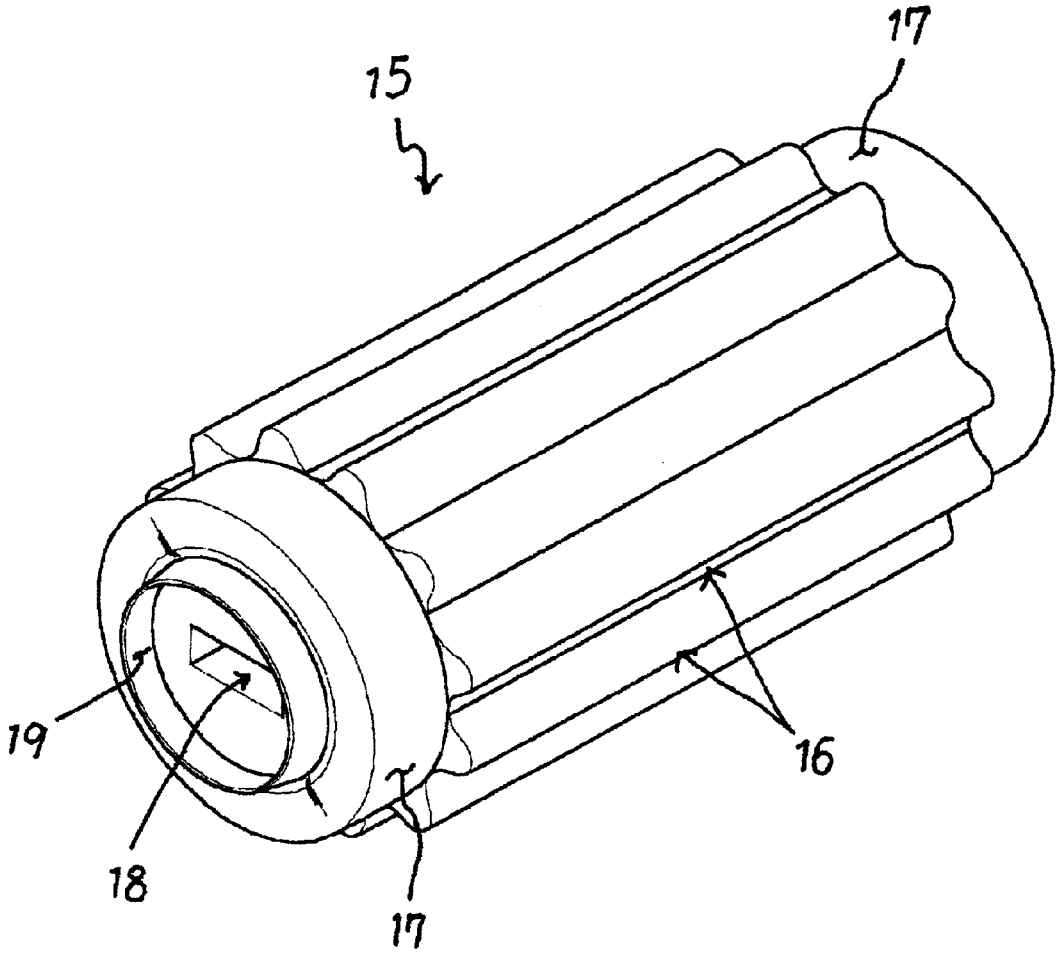
FIG. 2 is a perspective view illustrating a heat accumulator according to the embodiment of the present invention.
Figure 3:
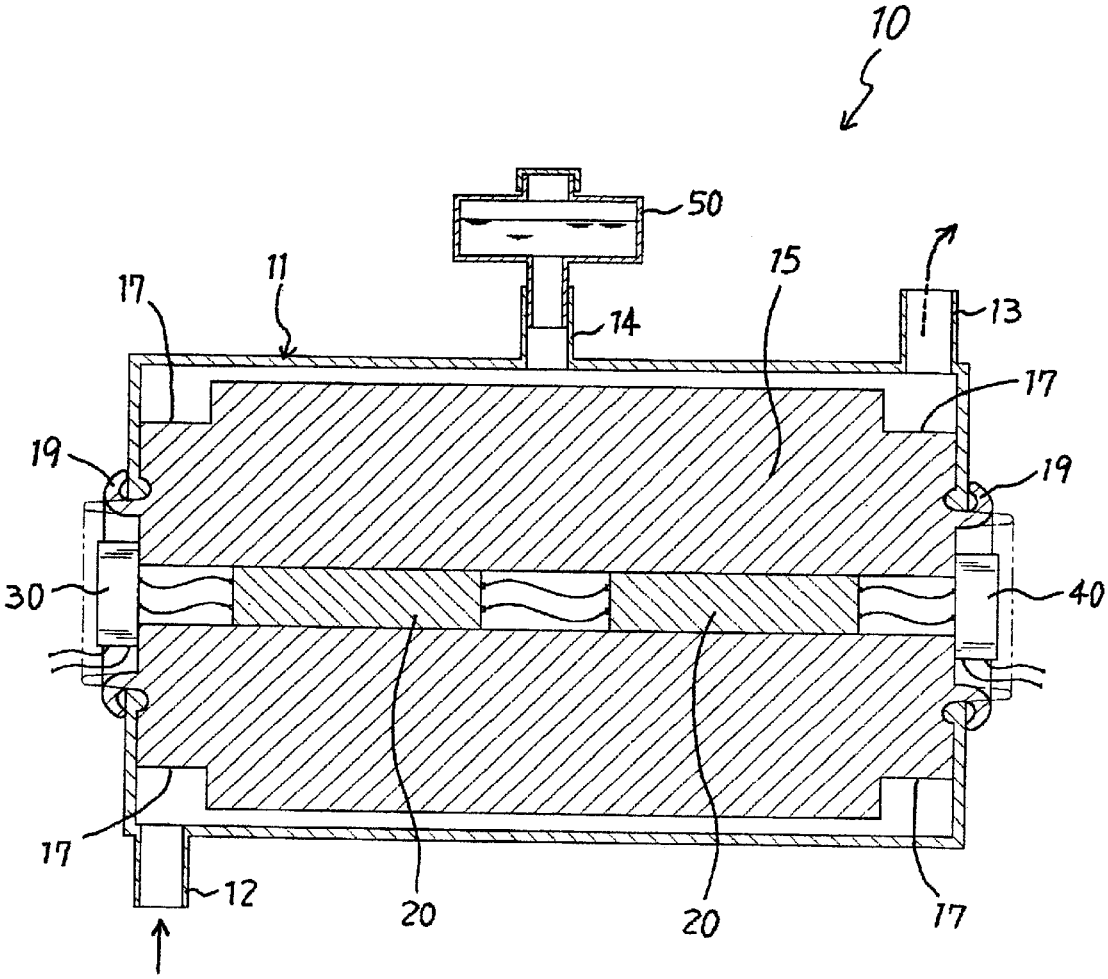
FIG. 3 is a cross-sectional view illustrating a hot water heating unit according to the embodiment of the present invention.

FIG. 1 is a perspective view illustrating a rubber casing 11 according to the present invention, and a heat accumulator 15 in FIG. 2 is accommodated in a hollow portion of the rubber casing. Referring to FIG. 3, the heat accumulator 15 is secured in the rubber casing 11, with fixing protrusion 19 formed on left and right sides of the heat accumulator 15 being pressed by a press to secure left and right sides of the rubber casing. With the construction, the rubber casing and the heat accumulator form an unitary body, such that a fluid medium in the rubber casing does not leakage.

The rubber casing includes an inlet port 12 connected to a hose extended from a circulating pump 60 and an outlet port 13 connected to a hot water pipe. Also, the rubber casing includes an auxiliary port 14 connected to a water supply tank 50 to supply a fluid medium, i.e., water.

The rubber casing 11 includes openings 90 on left and right sides thereof, so that the left and right sides of the accumulator 15 are exposed outwardly. Since the rubber casing has a characteristic of shock resistance, heat isolation, and non-corrosion, the durability of the rubber casing increases. Accordingly, a casting having a complicated heat isolation structure and a shock resistance structure.

The heat accumulator is made of metal or nonferrous metal, preferably a material of high heat transfer. In the embodiment of the present invention, the heat accumulator is made of aluminum, because of satisfying the economic and functionality. However, silver, copper, or gold may be used, and stainless steel or a common steel plated with an anti-corrosion coating.

The heat accumulator is provided on both sides with steps 17 for smoothly flowing the fluid medium in the rubber casing. A recessed portion 16 is formed between the steps 17, and the recessed portion has a height higher than that of the steps. It is noted that although the recessed portion 16 has a shape of gear, the shape may be modified, and a surface area of the recessed portion may be increased. Also, the heat accumulator 15 is provided on its center with a hole 18 for receiving heating members 20 and 20*a*. it is noted that a shape of the hole 18 may be modified in line with the shape of the heating member.

The hot water heating unit 10 comprises a positive temperature coefficient (PTC) or an electric ceramic, and is commonly used in an apparatus for maintaining a temperature up to about 300° C. Accordingly, a detailed description of the PTC will be shortened.

Figure 4:
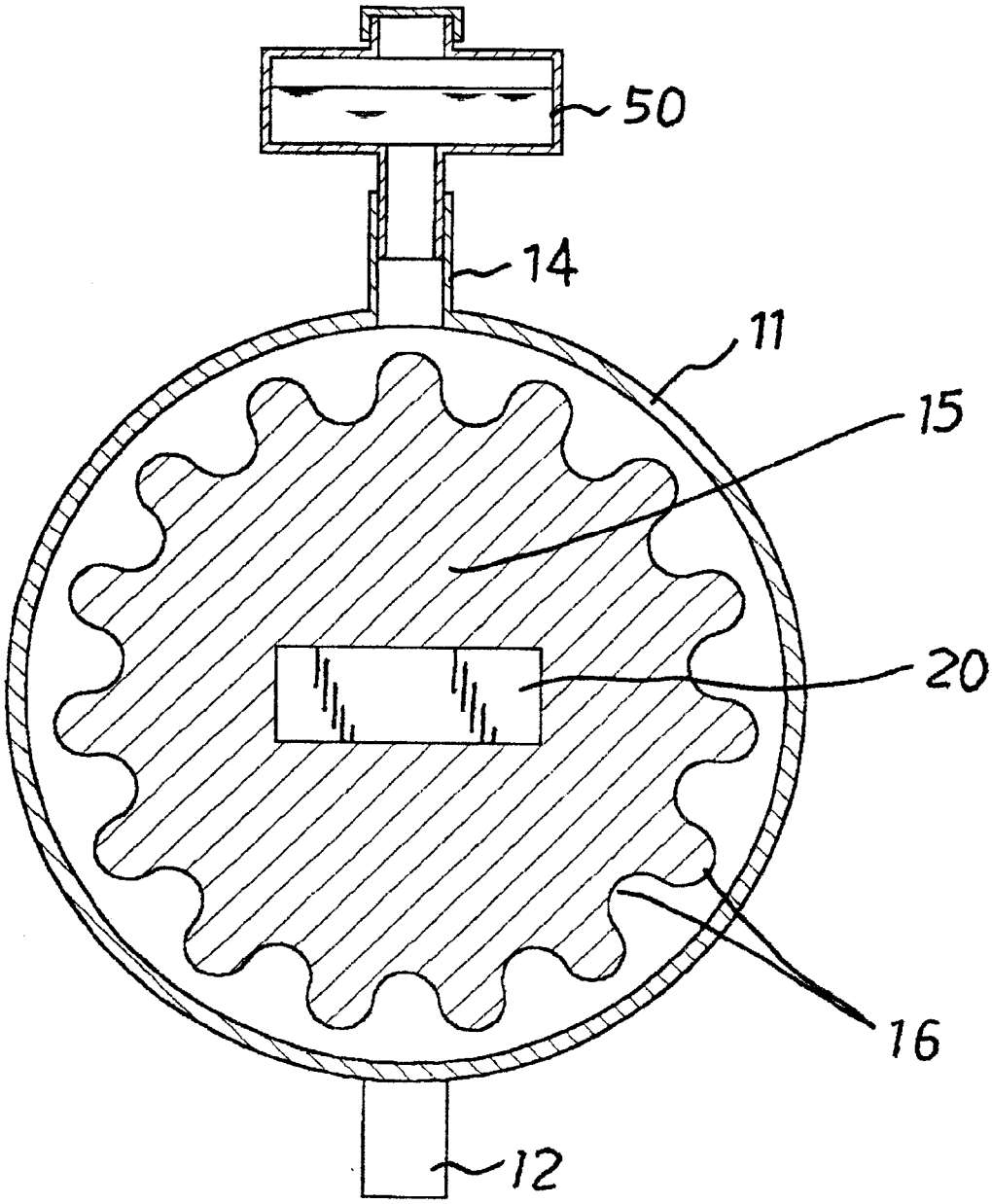
FIG. 4 is a cross-sectional view taken along a line 5—5 in FIG. 3.
Figure 5:
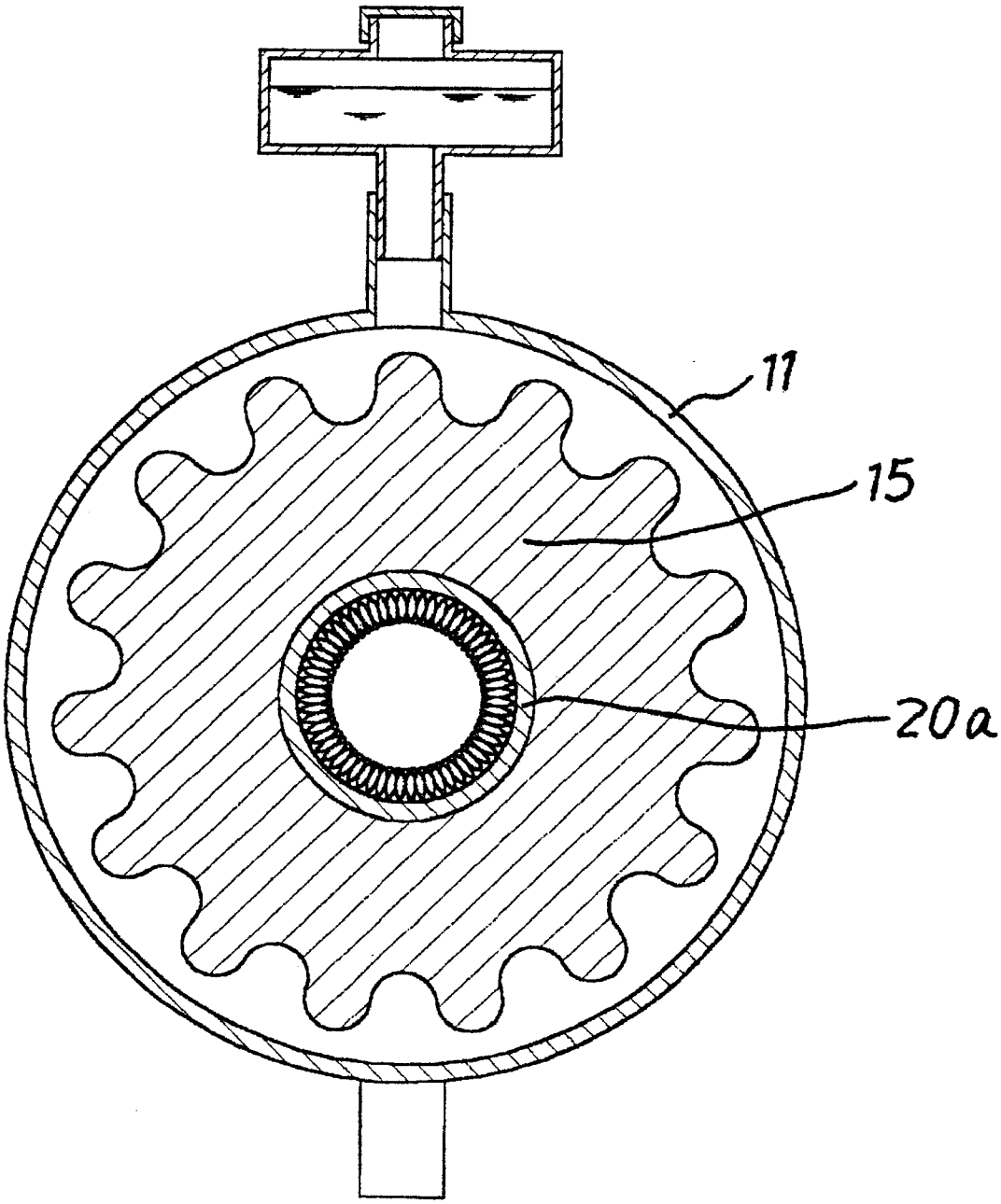
FIG. 5 is a cross-sectional view illustrating a hot water heating unit according to a modified embodiment of the present invention.

An embodiment of adopting the PTC is shown in FIG. 4, and an embodiment of adopting the electric heater is shown in FIG. 5. As will be known from the above description, the present invention may use any of the PTC and the electric heater as a heating member.

A temperature control unit 30 is engaged to the left side of the heat accumulator by means of an adhesive or a screw. The temperature control unit 30 controls a surface temperature of the heat accumulator, so that the fluid medium does not boil. If the surface temperature of the heat accumulator reaches to a boiling point of the fluid medium, the temperature control unit switches automatically off a power supplied to the heating member. If the surface temperature of the heat accumulator is lower to a predetermined temperature (below the boiling point of the used fluid medium), the temperature control unit switches automatically on the power supplied to the heating member to heat the heating member. Also, a temperature adjusting member 40 is adhered to the right side of the heat accumulator, so that a user can adjust a desired temperature of the fluid medium. If can adjust a voltage and a current applied to the heating member, thereby controlling a heating temperature of the heating member. Accordingly, it can adjust the temperature of the fluid medium flowing into the hot water pipe.

Figure 6:
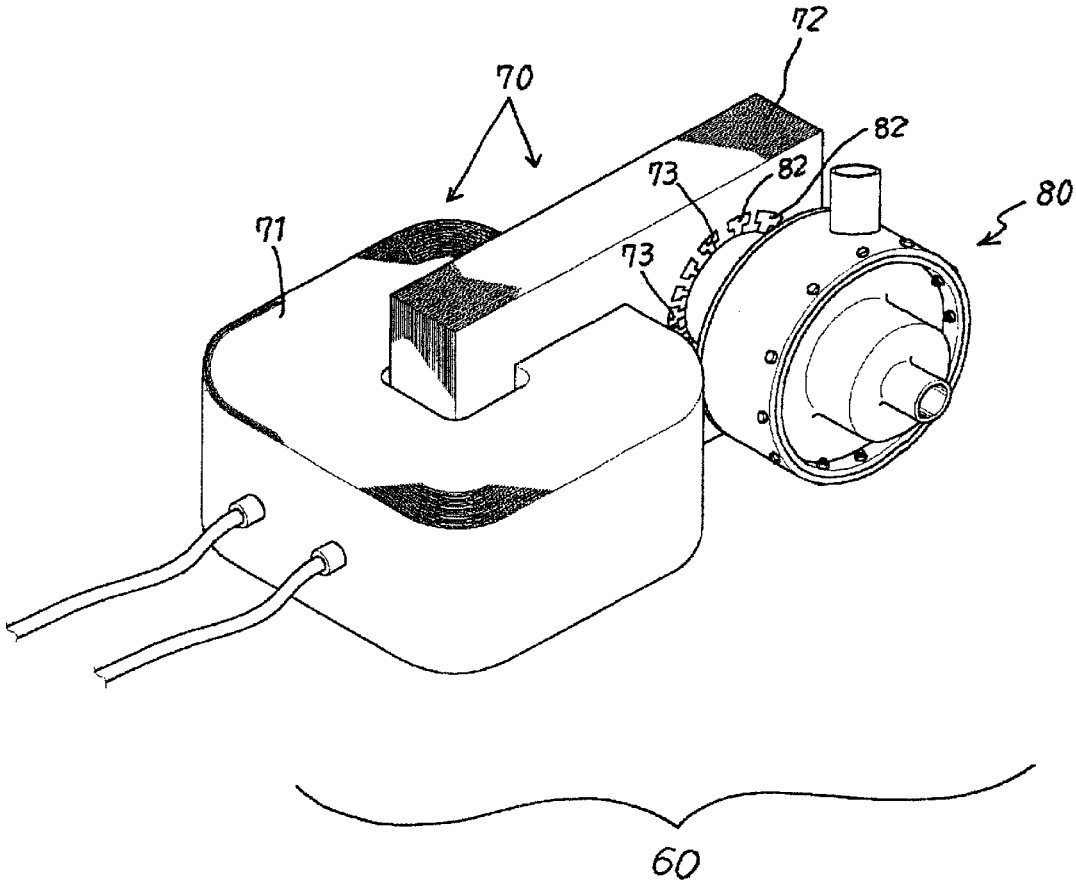
FIG. 6 is a perspective view illustrating a circulating pump according to the embodiment of the present invention.
Figure 7:
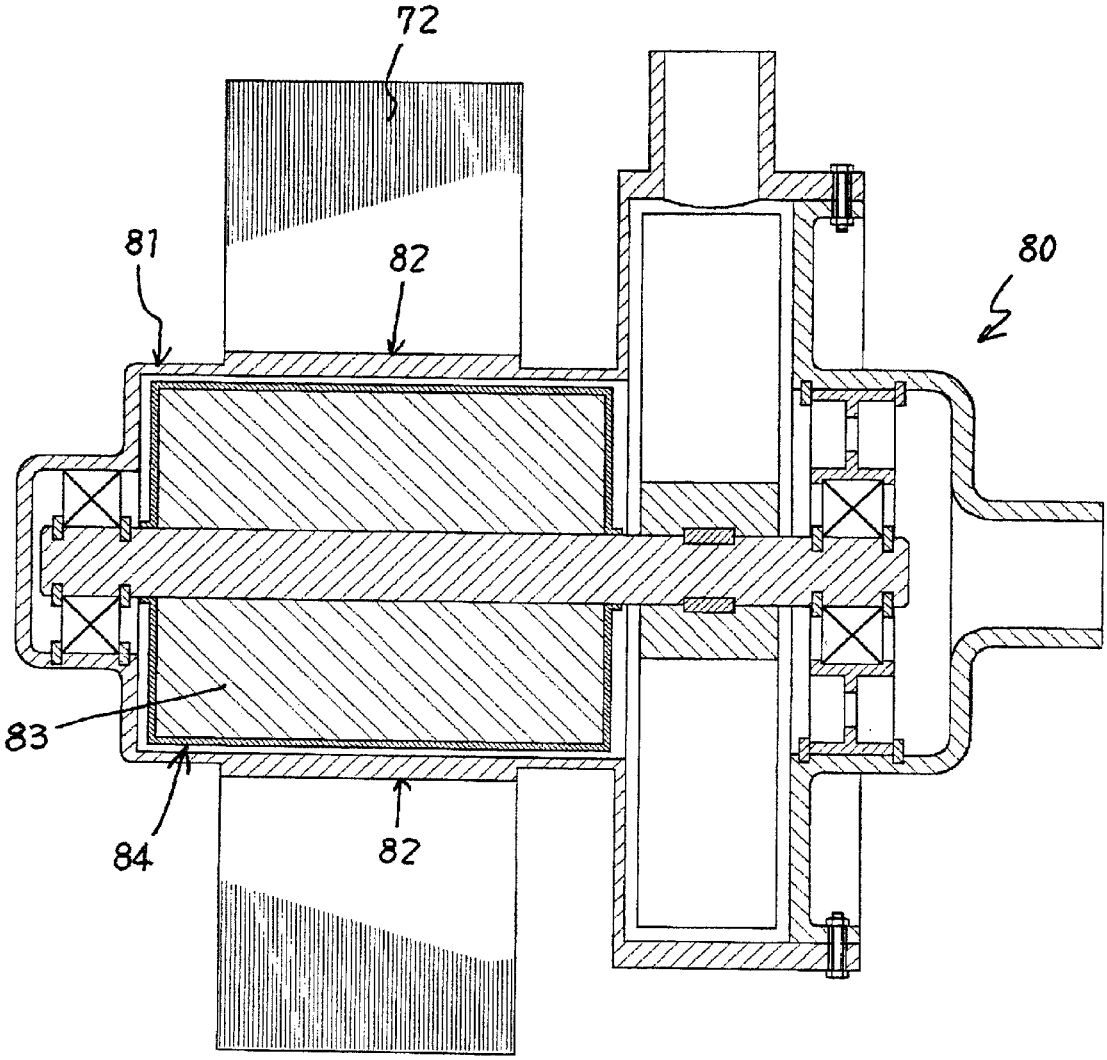
FIG. 7 is a cross-sectional view illustrating an assembled state of the circulating pump.

FIG. 6 shows a circulating pump 60 of the present invention, in which a shading motor 70 is used with a driving coil 71 being exposed. Such a shading motor operates not to produce a noise. The pump 80 is made of synthetic resin, and particularly a body of the pump 80 is made of synthetic resin. With the body 81 of the pump being inserted into a core 72 of the shading motor, the pump is manufactured by an insert injection process. Since T-shaped grooves 73 are continuously formed on a circumference of the core in a regular interval, the core is mounted into the injection molding to form the body 81. Accordingly, the body 81 is provided with T-shaped steps 82 inserted into the grooves 73 of the core 72, in order to form integrally the body 81 and the core 72.

With the above construction, if the body 81 is expanded by receiving the heat from the fluid medium, or is retracted by radiating the heat outwardly, the change of a diameter of the body does not happen. Therefore, a rotator 83 is always rotatable in the body 81. A surface of the rotor of the pump is coated with an anodizing coating film 84, thereby preventing the rotor from getting rust.

Figure 8:
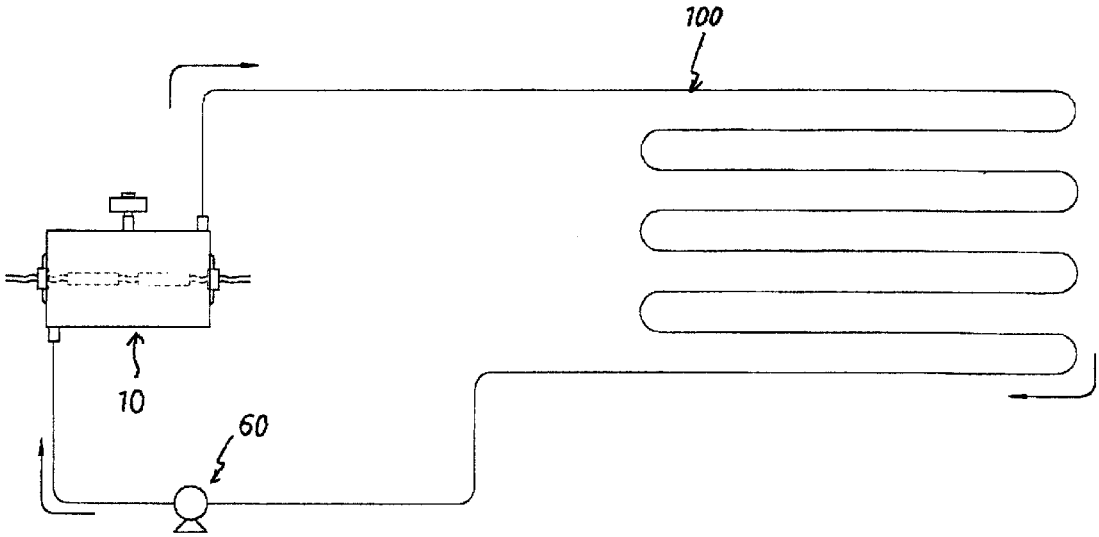
FIG. 8 is a systematic view illustrating schematically a case wherein the present invention is adopted.

The hot water heating unit 10 and the circulating pump 60 may be used as shown in FIG. 8.

The following is a test result of the present invention.

The heat accumulator was made of aluminum to have a diameter of 60 mm and a length of 100 mm, with a recessed portion having a type of gear. A PTC had a length of 18 mm, a width of 15 mm, and a height of 2.4 mm. A power of 220 volts was applied. It was noted that a heating temperature of the PTC is 270° C.

Water was used as a fluid medium. A hot water mat was made to have a horizontal dimension of 1500 mm and a vertical dimension of 2200 mm. A diameter of hose used in the hot water mat was 5 mm, and a whole length of the hose was 30 m.

When the heat accumulator had a diameter of 60 mm and a length of 100 mm, and 2 PTCs were used, a temperature of the water in a rubber casing was increased by 90° C., but did not increased above the temperature. Therefore, there is a relationship between the dimensions of the PTC and heat accumulator. Depending upon the dimension and number of the PTC and an indoor area to be heated, it is possible to calculate a preferred dimension of the heat accumulator. Of course, a number of small hot water generating units are connected to each other, without increasing the dimension of the hot water generating unit.

In the test, when the heat accumulator was released from the rubber casing, and only PTC was inserted into the rubber casing, the water contacted with the surface of the PTC was boiling immediately and produced bubbles. While the consumption of the power continued, the water was not heated. Accordingly, it was noted from the above results that such a case has not to overcome the drawbacks contained in the prior boiler.

However, when the heat generated from the PTC accumulated by means of the heat accumulator, in order words, when the indirect heating mode of the present invention was tested, the water contacted with the surface of the PTC did not boiling, such that the bubbles were not produced at all. Also, the water was heated immediately, and the consumption of the power was significantly decreased.

When the PTC was replaced with an electric heater capable of being heated by 300° C. in the atmosphere, the results were similar to those of the PTC. Accordingly, it will be noted that if the indirect heating mode of the present invention, i.e., the heat accumulator is used, the use of less energy can obtain a high efficiency.

In the test, a body of a circulating pump was not transformed, and the diameter and length thereof were not changed, although the hot water was flowing therein. Therefore, the position of the bearing was maintained, and the bearing operated properly.

In addition, when the supply of the power to the heating member was shut off, the heat accumulator heated by the heating member was cooled in a very slow speed. And, although the heating temperature was decreased, the accumulated heat heated the fluid medium continuously. When 5 to 10 minutes were lapsed after shutting off the supply of the power to the heating member, the heat accumulator conserved a heat of 50 to 60° C. At that time, if the power is applied to the heating member again, the temperature is immediately increased. Therefore, it will be noted that if the heat accumulator is sufficiently heated, the temperature of the heat accumulator is maintained at a predetermined point by applying less energy.

Although some preferred embodiments have been described, many modifications and variations may be made thereto in the light of the above teachings. It is therefore may be practiced otherwise than as specifically described.

Industrial Applicability

With the construction as described above, the present invention adopts a mode of indirectly heating the fluid medium using the heat accumulator which encloses the heating member, without directly heating the fluid medium using the heating member, so that it can prevent the bubbles from being produced, and obtain the high efficiency using less energy due to the effect of the heat conservation of the heat accumulator.

The present invention may be applied to a floor boiling apparatus of a house, as well as a hot water mat. In addition, the present invention may be adopted to a conventional boiler.

What is claimed is:

1. An electric boiler apparatus capable of indirectly heating a fluid medium, the apparatus comprising:

a rubber casing including a port for receiving a cool water, a port for exhausting a hot water, the ports being provided opposite to each other, and a port for receiving a supplement water, a hole formed on both sides thereof;

a heat accumulator accommodated into the rubber casing, secured to the rubber casing by fixing protrusions formed on both sides, and including recessed portions formed between a left and right step and having a height higher than that of the steps;

a temperature control unit, secured to a left side of the heat accumulator, for controlling a surface temperature of the heat accumulator;

a temperature adjusting unit, secured to a right side of the heat accumulator, for controlling a temperature of the hot water;

heating means inserted into a hole of the heat accumulator and being heated by a supplied power;

a hot water heating unit consisting of a supplement tank;

a circulating pump consisting of a shading motor; and a hot water pipe.

2. The apparatus as claimed in claim 1, wherein the heat accumulator is made of metal or nonferrous metal.

3. The apparatus as claimed in claim 2, wherein the heat accumulator is made of aluminum.

4. The apparatus as claimed in claim 1, wherein the heating means comprises a positive temperature coefficient.

5. The apparatus as claimed in claim 1, wherein the heating means comprises an electric heater.

6. The apparatus as claimed in claim 2, wherein the pump is secured by inserting T-shaped protrusion formed continuously on a circumference of a body into T-shaped grooves formed continuously on an inner periphery of the shading motor.

7. The apparatus as claimed in claim 1, wherein an outer surface of the pump is coated with an anodizing coating film.

8. The apparatus as claimed in claim 1, wherein the pump is made of synthetic resin.

* * * * *